US005275402A

United States Patent [19]

Malavazos et al.

[11] Patent Number: 5,275,402

[45] Date of Patent: Jan. 4, 1994

[54] COIN GAME WITH REVOLVING PUSHER

[76] Inventors: Alex Malavazos, 36 Bridal Path Ct., San Ramon, Calif. 94583; Gregory Malavazos, 42 Meadow Ct., Walnut Creek, Calif. 94595; Constantine Malavazos, 1538 Castro St., San Leandro, Calif. 94577

[21] Appl. No.: 21,044

[22] Filed: Feb. 23, 1993

[51] Int. Cl.[5] ..... A63F 7/02

[52] U.S. Cl. ..... 273/138 A; 273/440; 273/454

[58] Field of Search 273/138A, 138R, 140, 440, 441, 454, 459, 460

[56] References Cited

U.S. PATENT DOCUMENTS 4,662,636 5/1987 Crompton ..... 273/138 A
4,744,566 5/1988 Malavazos et al. ..... 273/357

FOREIGN PATENT DOCUMENTS 2114452 8/1983 United Kingdom ..... 273/138 R
2124913 2/1984 United Kingdom ..... 273/138 A

*Primary Examiner*—Benjamin H. Layno
*Attorney, Agent, or Firm*—Harris Zimmerman

[57] ABSTRACT

A moving coin pusher on a game board revolves in a pattern of movement which causes it to approach and retreat from the edges of the board in a cyclical manner. Players drop coins on to the board, preferably in an upright rolling orientation, through a coin chute which may be swivelable to enable aiming of the coins. Players score when coins drop off of an edge of the board or through one or more holes in the board. The holes, which may have different scoring values, are preferably at locations which are covered and uncovered in a cyclical manner by the revolving coin pusher.

24 Claims, 5 Drawing Sheets

COIN GAME WITH REVOLVING PUSHER

TECHNICAL FIELD

This invention relates to amusement devices and more particularly to game apparatus of the coin pusher type in which player's coins are directed to the surface of a game board, in which a motor driven coin pusher on the board approaches and retreats from an edge of the board in a cyclical manner and in which players score when coins drop off the edge of the board.

BACKGROUND OF THE INVENTION

Prior coin pusher games typically have a level game board for supporting an accumulation of coins or coin-like tokens and a motor reciprocates a linear coin pusher slat at an area of the board that is spaced from an edge of the board. Players direct coins into the coin accumulation through a coin guide which may be swivelable to enable aiming of the coins. The reciprocating pusher causes coins to migrate towards an edge of the board and to drop off at the edge singly or in groups. The discharge of coins is not uniform owing to differences in the stacking and distribution of coins that occur at different times. Thus the outcome of each introduction of a player's coin is subject to a strong element of chance.

The capability of swiveling the coin guide injects a skill component into the outcome of the game. The player may aim the guide in a selected direction in an attempt to destabilize a grouping of coins that appears about to drop from the edge of the board.

Coin pusher games would be more attractive and interesting to players if the coins exhibited more varied and more complex patterns of movement than occur in the prior devices. For the same reasons, it would be advantageous to provide the option of introducing a greater skill factor into the game.

Some prior coin pusher games of the above described type enable simultaneous play by two players as each can be stationed at an opposite side of the reciprocating pusher. A coin pusher construction which is adaptable to a greater number of simultaneous players would be advantageous to the commercial establishments where such such games are typically located and also to groups of persons who wish to play at the same time in proximity to each other.

The present invention is directed to overcoming one or more of the problems set forth above.

SUMMARY OF THE INVENTION

In one aspect, the present invention provides coin game apparatus which includes a game board having a substantially level surface for supporting a plurality of coins or the like and having at least a first edge region at which coins may be pushed off the surface and dropped from the board. A movable coin pusher is disposed on the board surface and pusher drive means revolves the pusher about a first vertical axis of revolution. The apparatus further includes at least one coin chute for receiving and guiding player's coins and which has a coin release end positioned to drop the coins on to the board surface.

In another aspect of the invention, the coin chute has a coin guiding slot with a configuration which positions the coins in an upright orientation to cause rolling motion of the coins.

In another aspect of the invention, the apparatus includes means for swiveling the coin chute and the board surface has at least one hole into which the player's coins may drop when the coin chute is positioned to direct coins toward the hole. In another aspect, the hole is at a location which is cyclically covered and uncovered by the revolving coin pusher.

In another aspect of the invention, the pusher drive means also revolves the coin pusher about a second vertical axis that is spaced apart from the first axis of revolution.

In another aspect of the invention, the game board has a plurality of separate edge regions at which coins may be pushed off of the game board surface and the apparatus includes a plurality of the coin chutes each being positioned for dropping player's coins on to the board surface in the vicinity of a separate one of the edge regions.

In still another aspect, the invention provides coin game apparatus which includes a cabinet having a substantially level floor forming a game board, upwardly extending side walls and a top formed at least in part of transparent material. The game board has opposite side regions at which coins may be pushed off of the board and has a plurality of holes through which coins may drop, the holes being spaced apart from the edge regions and from each other. A movable coin pusher is disposed on the game board and means are provided for revolving the pusher about a vertical axis of rotation in a manner which causes the exterior surface of the pusher to move towards and away from each of the edge regions in the course of revolving about the axis whereby coins may be pushed off of the edge regions of the board by the motion of the pusher. First and second coin chutes are attached to the cabinet at the opposite side regions of the game board and are positioned to drop player's coins on to the board. Each chute has a coin guiding slot shaped to position coins in an upright orientation. Means are provided for swiveling the coin chutes whereby players may aim rolling coins at the holes in the game board.

The invention provides game apparatus of the coin pusher type which is more attractive to potential players, more exhilarating and challenging to play and at which player skill can be a more significant factor than in prior game apparatus of this general type. The revolving coin pusher causes coins to travel in more varied and complex patterns of movement than has heretofore been the case. In the preferred form of the invention, players have the option of attempting to score by aiming rolling coins at holes in the game board while avoiding the revolving pusher or attempting to dislodge coins which are at an edge of the board by bouncing a coin off of the moving pusher. The invention can be adapted to accommodate a number of simultaneous players thereby effecting space savings and increasing revenue in commercial establishments and enabling groups of persons to play together.

The invention, together with further aspects and advantages thereof, may be further understood by reference to the following description of preferred embodiments and by reference to the accompanying drawings.

DETAILED DESCRIPTION OF THE PREFERRED EMBODIMENTS

Figure 1:
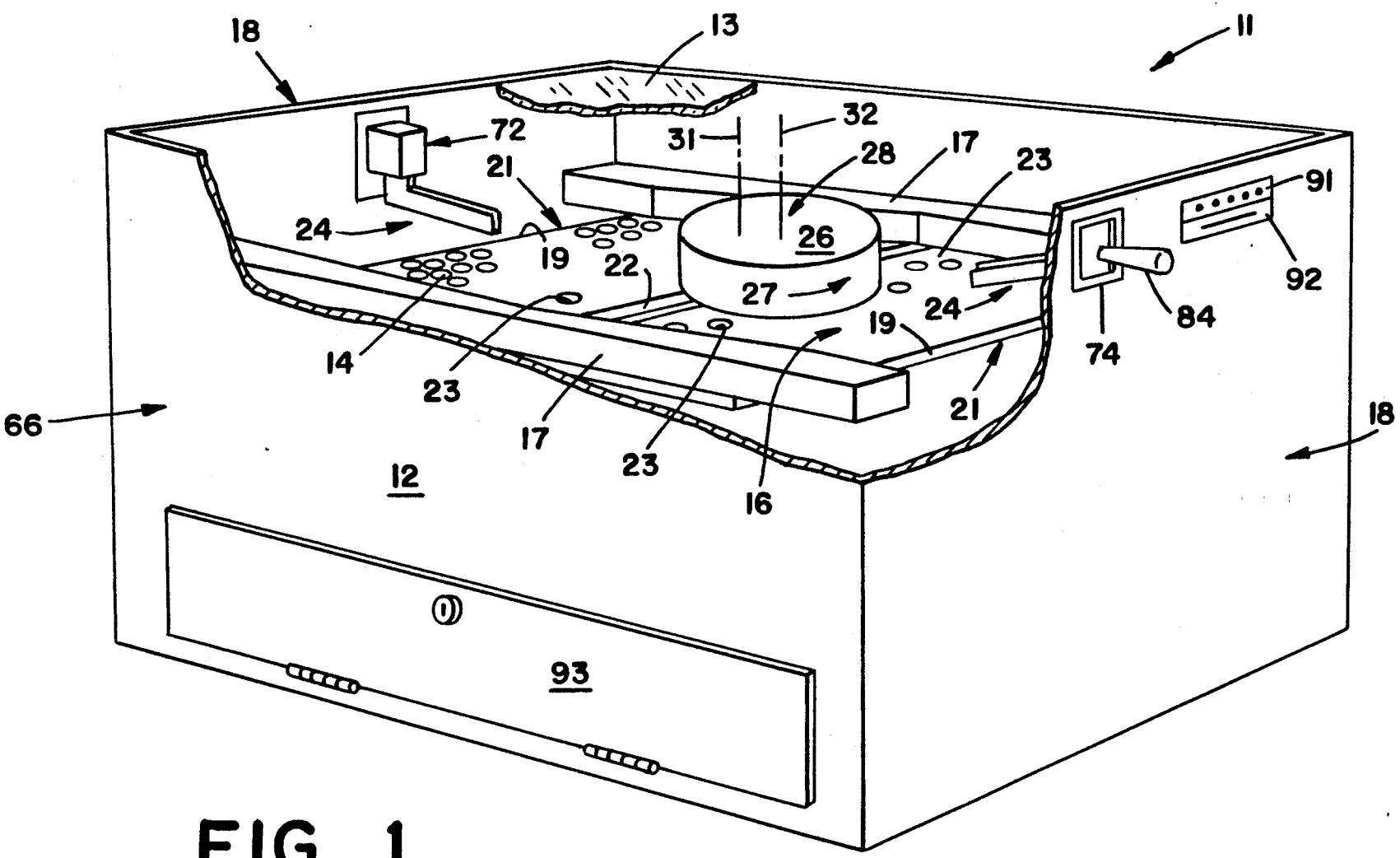
FIG. 1 is a broken out perspective view of coin game apparatus embodying the invention.

Referring initially to FIG. 1 of the drawings, the coin game apparatus 11 of this embodiment of the invention housed in a rectangular cabinet 12 having a transparent top 13 which enables players to see the upper region of the interior of the cabinet. It is desirable to prevent player access to the cabinet interior with a top 13 of this kind when the coins 14 within the device have monetary value and/or there is concern about players reaching into the cabinet and removing or manipulating coins. A closed cabinet may not be needed in some cases where these conditions are not present.

A level, flat upper floor within the cabinet 12 is situated below top 13 in spaced apart relationship with the top and functions as a game board 16. Opposite sides of the playing area are bounded by rails 17 which extend between cabinet end walls 18 along the upper surface of game board 16. Game board 16 has a length that is smaller than the length of cabinet 12 and is centered between the opposite end walls 18 of cabinet 12. Thus a pair of transverse slots 19 extend within the cabinet 12 and are situated adjacent opposite edges 21 of game board 16. The slots 19 are of sufficient size to enable coins 14 to fall off of game board 16 and drop towards the lower region of the cabinet 12.

A players score or reward is determined in part by the number of coins 14, if any, that drop through one of the slots 19 which may be termed the players slots. When the apparatus 11 is intended for use in a commercial establishment, arrangements for reimbursing the proprietors are usually needed. This may be accomplished by enabling dropping of a portion of the coins 14 from the board 16 at one or more locations that are away from the players slots 19. In this embodiment two aligned coin collection openings 22, which may be referred to jointly as the house slot, extend in parallel relationship with board edges 21 midway between such edges and at opposite sides of the center of the board. Coins 14 which drop through openings 22 are in effect the proprietors reimbursement as they are not available for pushing into the players slots 19.

The players score or reward can be determined solely by the coins 14 which drop through the players slot 19 in some embodiments of the invention. Preferably one or more holes 23 are present in the board 16 to provide the player with another way of scoring. By aiming coin chutes 24, which will hereinafter be described in more detail, the player may attempt to roll coins which are inserted into a chute towards a hole 23 and may win some predesignated award if a coin drops through the hole. This adds excitement and challenge to the game and introduces a greater skill factor into the game.

In this embodiment, six holes 23 are present in the board 16 between each edge 21 and the coin collection openings 22 which holes are closer to the latter than the former. Holes 23 which are further from a coin chute 24 and closer to a coin collection opening 22 may be assigned a higher scoring value than others of the holes. Although it is not essential in all instances, additional challenge is added to the game by situating the holes 23 at areas of board 16 which are cyclically covered and uncovered by a revolving coin pusher 26. revolving coin pusher 26.

Figure 2:
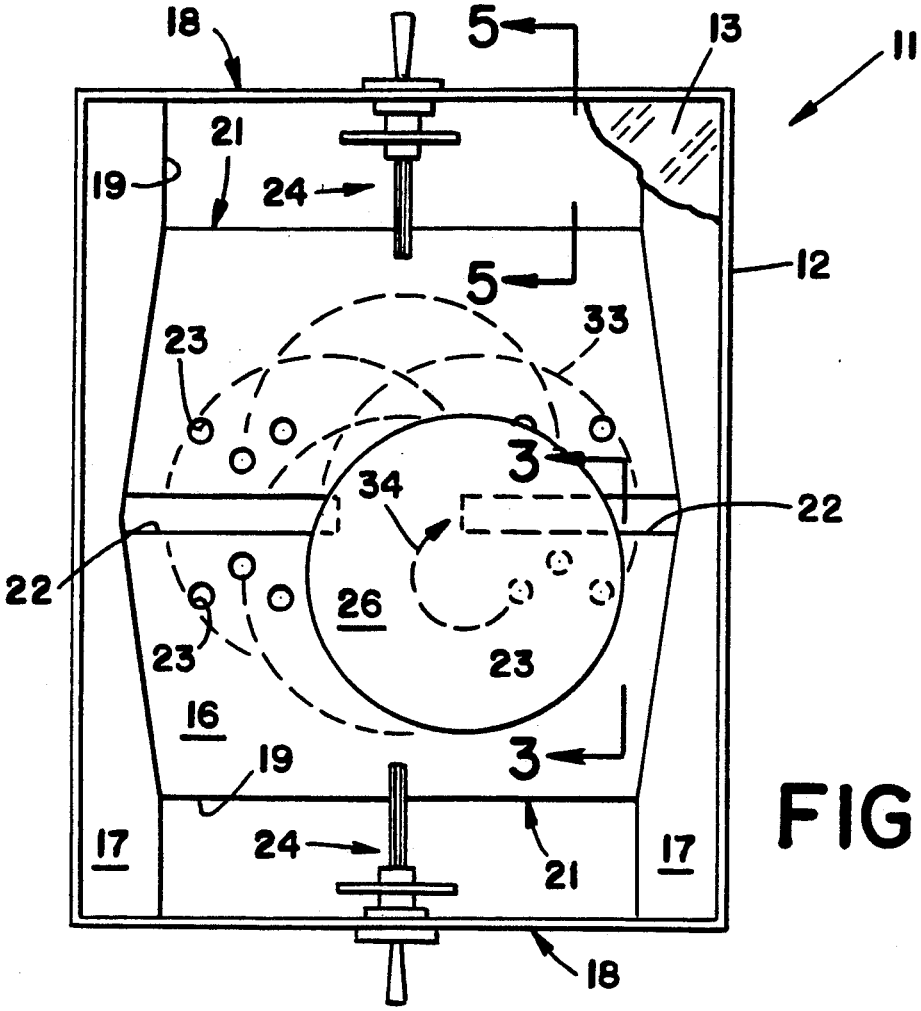
FIG. 2 is a top view of the apparatus of FIG. 1.

Coin pusher 26 in this example has a cylindrical side wall 27 which extends upward from the surface of board 16 and which is spanned at the top by a circular upper face 28. Other configurations are possible, examples of which will hereinafter be described. The pusher 26 is revolved in a manner which causes the exterior surface of the pusher side wall 27 to advance towards and retreat from board edges 21 in a cyclical manner. As indicated by dashed lines 26*a* in FIG. 2, the pattern of movement does not carry the pusher 26 all the way to board edges 21. Thus the pusher does not directly push individual coins 14 into the players slots 19 but does so indirectly by sweeping newly arrived coins into the accumulation of coins which rests on board 16 outside the area that is swept by the pusher. Incoming coins may also be deflected by the pusher 26 and land in the accumulated mass. These processes result in a gradual migration of coins towards the players slots 19. The migrating coins 14 do not drop through players slots 19 at a constant rate in response to successive incoming player's coins as the coins 14 in the mass tend to have a non-uniform distribution and may mound up more thickly at some areas of the board 16 than at others. Consequently, there is a component of chance in outcome of each successive arrival of a new player's coin. Arrival of a new coin may not be followed by dropping of any coins 14 into players slot 19 or a single coin may be dropped or a number of coins may drop.

Players may attempt to dislodge a grouping of coins 14 that is adjacent to the board edge 21 by aiming a coin chute 24 to bounce the coin off of pusher 26 in the direction of the grouping. This introduces another component of skill into the game but even the best players cannot count on a continuous payoff.

The terms "revolving" and "revolution" as used herein and in the following claims should be understood to refer to either rotation of the pusher 26 about its own center or orbital motion around an axis that is spaced apart from the center of the pusher or to other forms of rotary movement which cause the side wall 27 to move towards and then away from board edges 21 in a repetitive manner. In this embodiment, the pusher 26 orbits about a first vertical axis of revolution 31 that is situated at the center of game board 16 while simultaneously rotating about a second vertical axis of revolution 32 that extends through its own center and which is spaced apart from the first axis. The resulting pattern of movement, depicted by dashed lines 33 and 34 in FIG. 2, enhances interest in the game on the part of players and causes the trajectories of coins which strike the pusher 26 to be more varied and unpredictable.

Figure 3:
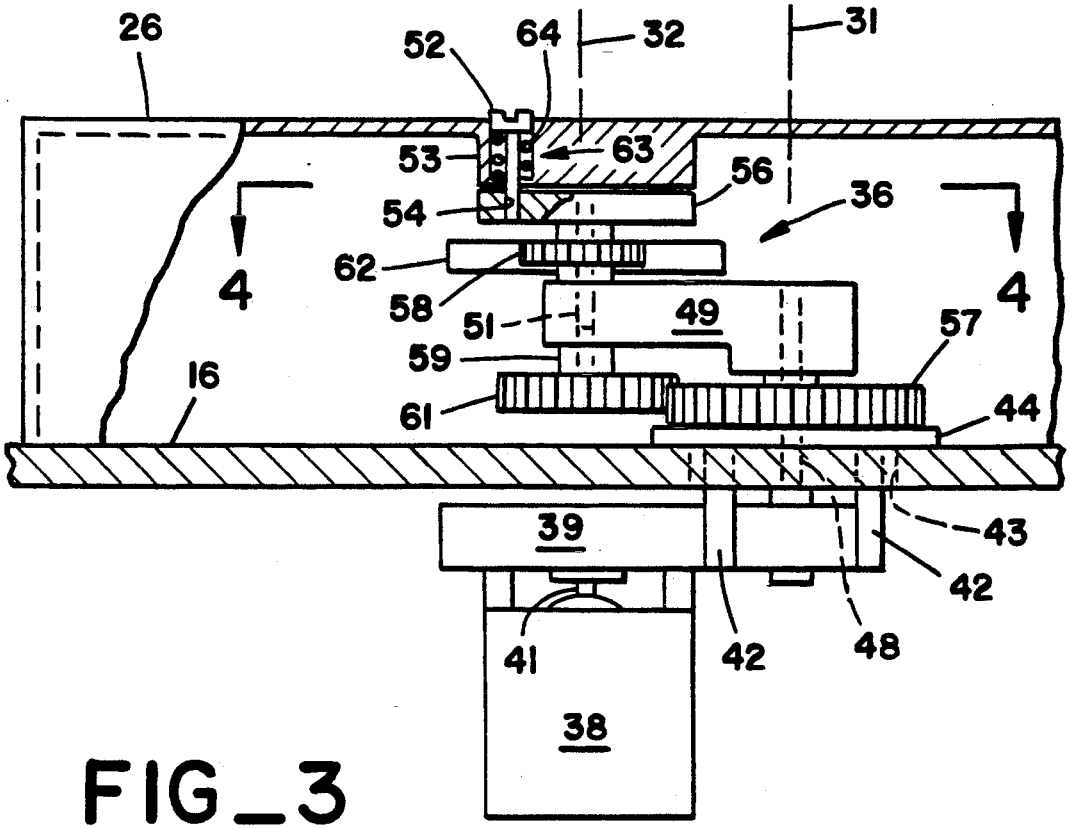
FIG. 3 is a section view taken along line 3—3 of FIG. 2 depicting drive means for the revolving coin pusher component of the apparatus.
Figure 4:
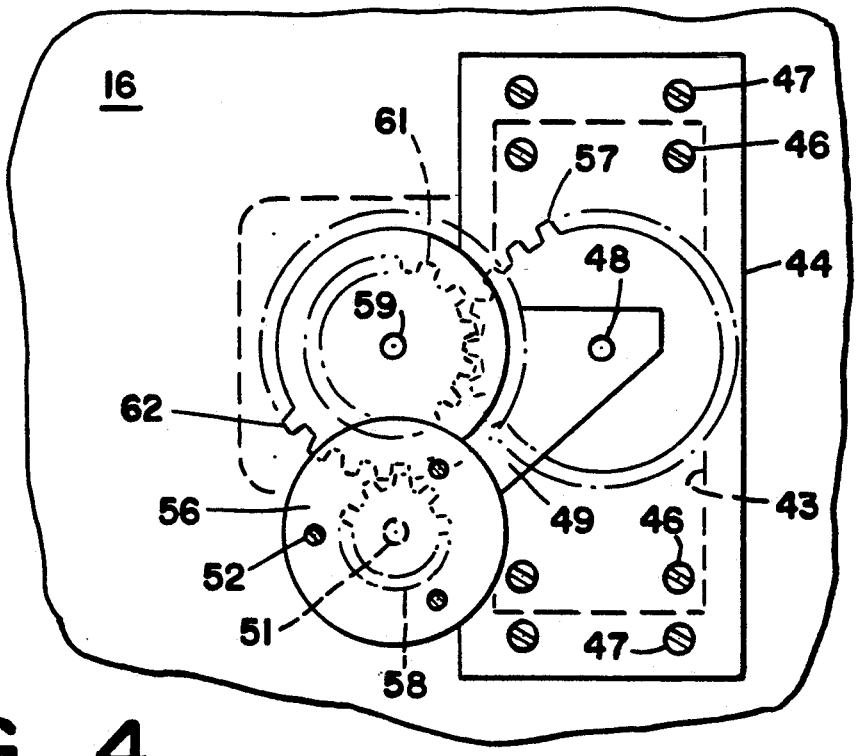
FIG. 4 is a section view taken along line 4—4 of FIG. 3.

Referring jointly to FIGS. 3 and 4, the above described pattern of movement is brought about by pusher drive means 36 which includes an electrical motor 38. Motor 38 is secured to a speed reducing gearbox 39 and turns the input shaft 41 of the gearbox, the motor and gearbox being situated below game board 16. Gearbox 39 has support posts 42 which extend up through an opening 43 at the center of game board 16 and which are secured to a mounting plate 44 by screws 46. Plate 44 spans opening 43 and is secured to the top surface of game board 16 by additional screws 47. The drive output of gearbox 39 is a first upright rotatable shaft 48 which extends up through opening 43 in the game board 16. Shaft 48 is situated at the center of game board 16 and defines the first axis of revolution 31 of the coin pusher 26.

A pusher orbiting arm 49, which may be of essentially right triangular shape, is secured to the upper end of shaft 48 and undergoes pivoting motion about first axis 31 as the shaft rotates. The second axis of revolution 32 of coin pusher 26 is defined by a second rotatable shaft 51 that extends upward from arm 49 at a location which is horizontally spaced from the first axis 31.

Coin pusher 26 is centered over the second rotatable shaft 51 and is coupled to shaft 51 for rotation therewith by screws 52. Screws 52 seat in wells 53 in the pusher 26 and have threaded lower ends which engage in threaded bores 54 in a drive disk 56 that is secured to the top of second shaft 51 in coaxial relationship with the shaft.

In order to rotate pusher 26 about the second axis 32, a stationary first gear 57 is disposed in coaxial relationship with the first shaft 48 between mounting plate 44 and arm 49 and is secured to the mounting plate. A second gear 58 is secured to second shaft 51 above arm 49 and rotates with the shaft 51. A third rotatable shaft 59 extends both upward and downward from the arm 49 at a location which is spaced apart from both the first shaft 48 and the second shaft 51. Third and fourth gears 61 and 62 are secured to the third shaft 59 for rotation therewith, gear 61 being below arm 49 and being engaged with the stationary first gear 57 while gear 62 is above the arm and engages the second gear 58.

Thus the pivoting motion of arm 49 about first axis 31 causes third gear 61 to ride around the stationary first gear 57 and to be rotated in the process. This rotates the fourth gear 62 which in turn rotates the second gear 58 thereby causing rotation of the coin pusher 26 about the second axis 32.

With reference to FIG. 3 in particular, it is preferable to provide means 63 for exerting downward pressure on coin pusher 26. This assures that the lower edge of the pusher 26 will not override coins and entrap them in the interior of the pusher. Such means 63 in this example are compression springs 64 disposed in wells 53 in coaxial relationship with screws 52 and which exert forces against the heads of the screws and the lower end walls of the wells that press pusher 26 downward against game board 16. Drive disc 56 is slightly spaced apart from the underside of the center of pusher 26 to enable springs 64 to act in this manner.

Figure 5:
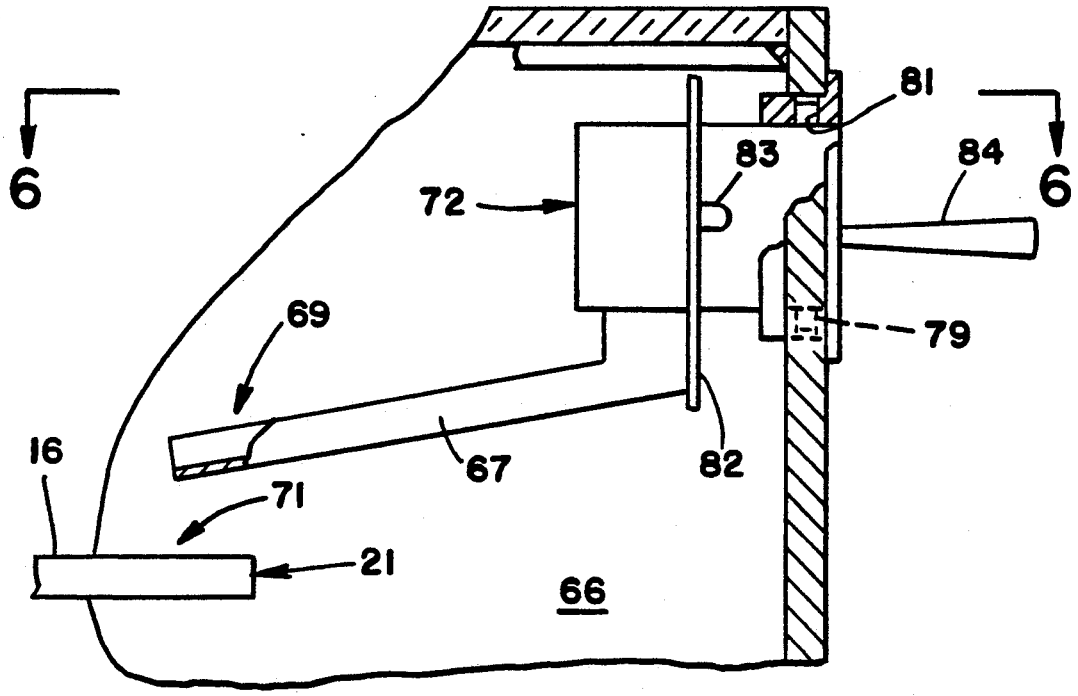
FIG. 5 is a broken out section view taken along line 5—5 of FIG. 3 and depicting a coin chute component of the apparatus of the preceding figures.
Figure 6:
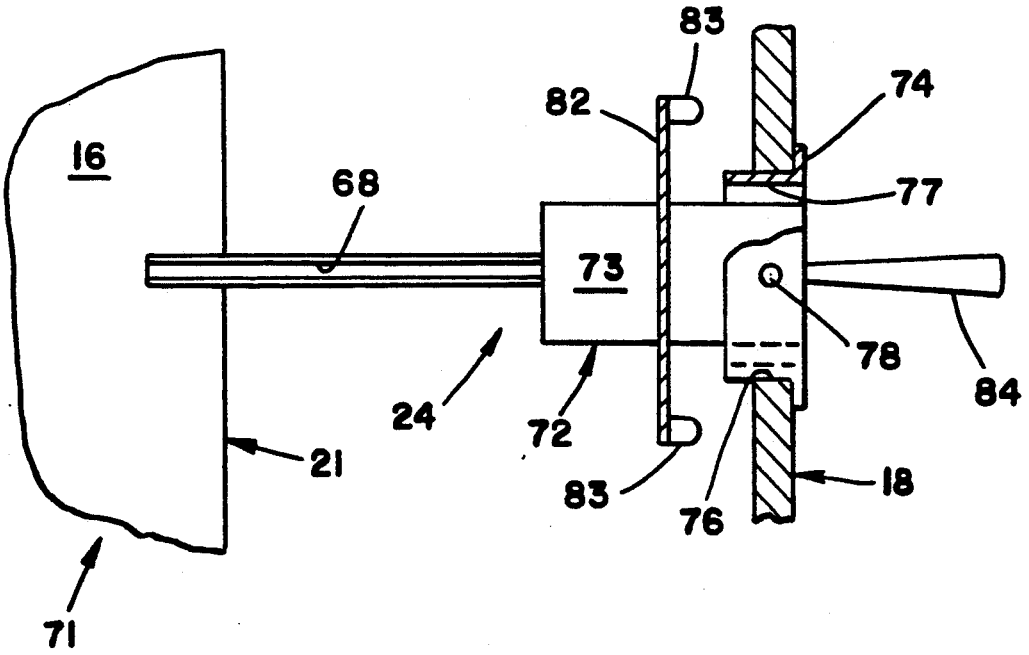
FIG. 6 is a plan section view taken along line 6-6 of FIG. 5.

Referring to FIGS. 5 and 6 in conjunction, the coin chutes 24 are situated above the level of game board 16 midway between the side walls 66 of cabinet 12. Each chute 24 has an elongated coin guide member 67 forming a linear coin guiding slot 68 that is sufficiently thin to maintain coins in an upright or on edge orientation and enable rolling of the coin along the slot which inclines downwardly towards game board 16. The guide member 67 has a coin releasing end 69 which is situated over the adjacent edge region 71 of board 16 in position to drop the coins on to the board preferably at a location which is within the area that is swept by the coin pusher.

In coin pusher apparatus designed for use in commercial establishments, coins are fed into the upper end of guide member 67 through a coin verifier 72 to which the upper end of the member may be secured. Coin verifier 72 may be of the well known form widely used in gaming apparatus, pay telephones and the like and which functions to detect and reject unauthorized coin like objects.

The front end of the housing 73 of coin verifier 72 fits into a rectangular bezel frame 74 which is secured to cabinet end wall 18 at a conforming opening 76 in the wall. The rectangular opening 77 formed by frame 74 has a height similar to that of the housing 73 but is of greater width to enable swiveling of the housing and coin guide member 67 about a vertical axis. Aligned pivot pins 78 and 79 extend from the top and bottom respectively of housing 73 into conforming passages 81 in frame 74 to establish the vertical pivot axis and to couple the housing to the frame.

A rectangular flange 82 extends outward from housing 73 at a location which is spaced apart from frame 74 and the cabinet end wall 18. At each side of housing 73, a resilient stop 83 is secured to the flange 82 in position to contact end wall 18 at the desired limit of swiveling of the housing 73 and coin guide member 67. A handle 84 extends outward from the coin insertion face of each housing 73 and is shaped for grasping by a player to enable selective swiveling.

Figure 7:
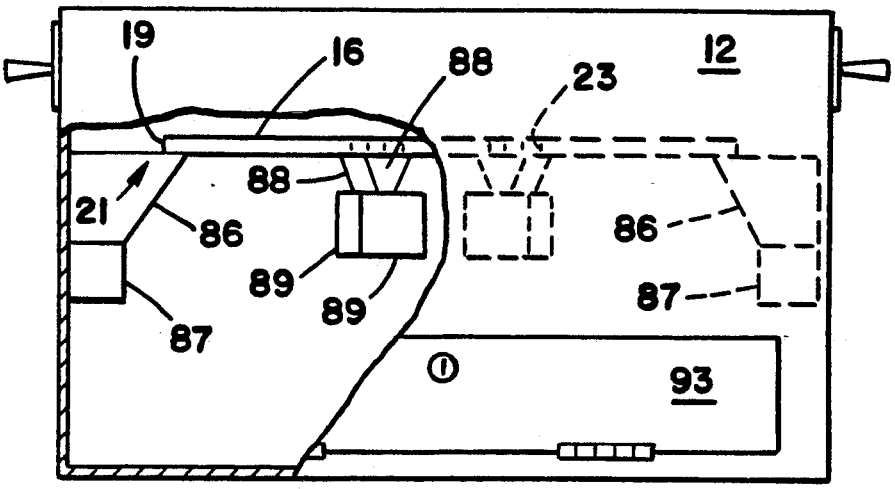
FIG. 7 is a broken out side view of the apparatus of the preceding figures.
Figure 8:
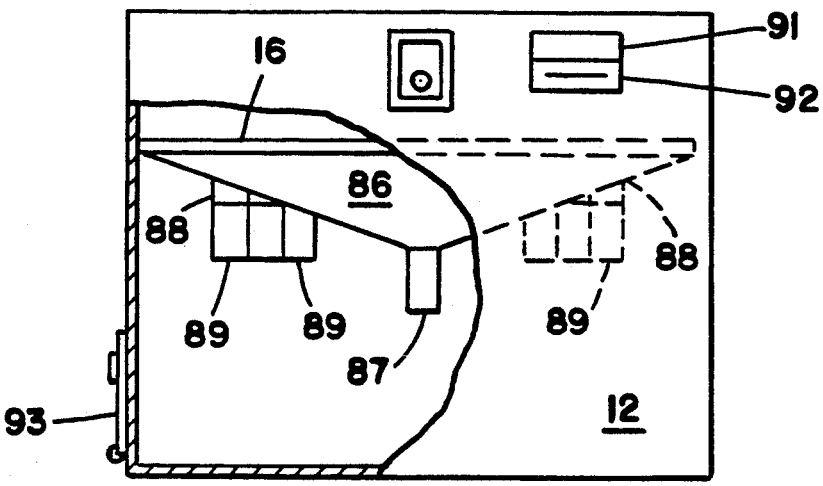
FIG. 8 is a broken out end view of the apparatus of of the preceding figures.

Referring jointly to FIGS. 7 and 8, the present embodiment of the invention is designed for use in commercial establishments where coins are not returned to a player but in which coins which drop from board 16 are counted and the player receives a ticket or coupon which is redeemable for something of value. In this example, a funnel like hopper 86 is situated below each players slot 19 to receive coins which drop from the board edge 21 and to feed such coins into a coin counter 87 which may be of the known form used in game apparatus and other types of mechanism. Additional smaller hoppers 88 receive coins which drop through individual ones of the players holes 23 and deliver such coins to separate additional coin counters 89. Separate coin counters 89 are provided where coins which drop through different ones of the players holes 23 are to be accorded different score values. The counters 87 and 89 may, if desired, be of the type which provide electrical signals enabling automatic computation of the players score, readout of the score at a digital display 91 or the like and/or delivery of a ticket or coupon at a ticket dispenser 92, suitable circuits and equipment for this purpose being well known to the art.

Scoring of the game does not necessarily require the particular equipment described above. In simpler versions of the apparatus, dropped coins may be manually counted or, in localities where gaming laws permit delivery of coins to winning players, hoppers 86 and 88 may be replaced with coin chutes which are accessible from outside of cabinet 12.

A key locked hinged access door 93 in the side of cabinet 12 enables periodic removal of the accumulation of coins which have dropped from the coin counters 87 and 89.

The configuration and/or pattern of movement of the revolving coin pusher can be different in other embodiments of the invention. For example, with reference to FIG. 10, a circular pusher 26*a* may be driven directly by the rotating shaft 48 which is at the center of game board 16 provided that it is in an eccentric relationship with the shaft. This enables elimination of the pivoting arm 49, third shaft 59, and gears 57, 58, 61 and 62 of FIG. 3 thereby simplifying the mechanism. Referring to FIG. 11, a modified pusher 26*b* can be coupled directly to the rotating shaft 48 at the center of game board 16 in a centered relationship with the shaft and board if it has a non-circular shape, the pusher 26*b* being square in this case. Referring to FIG. 12, such a pusher 26*c* need not necessarily have a polygonal shape. The pusher 26*c* in this example has a propeller like shape with curved lobes 94 that extend in opposite directions from the axis of the rotating shaft 48 which directly rotates the pusher. In each of the above described embodiments, the shape of the coin pusher or the drive structure or a combination of both cause the pusher to approach and retreat from the edges of the board in a cyclical manner during revolution of the pusher.

Figure 10:
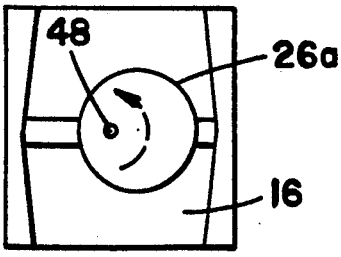
FIG. 10 is a top view of a first modified form of revolving coin pusher that may be substituted for the coin pusher depicted in the preceding figures.
Figure 11:
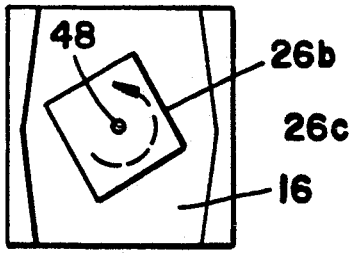
FIG. 11 is a top view depicting a second modification of the coin pusher.
Figure 12:
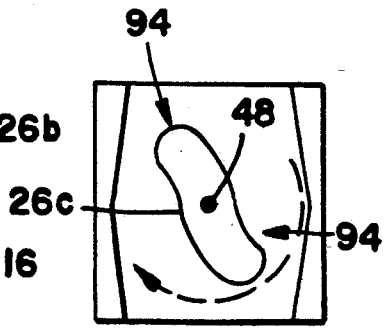
FIG. 12 is a top view of a third modification of the coin pusher.

The forms of coin pusher 26, 26*a* and 26*b* shown in FIGS. 1, 10 and 11 respectively can be revolved in either direction. In fact challenge in the game can be enhanced by using a drive motor of the type which cyclically reverses drive direction. Some other forms of coin pusher, such as the pusher 26*c* of FIG. 12, are preferably revolved in a particular rotary direction as reversed rotation may cause the pusher to entrap coins and push them around in a circle rather than urging the coins outward towards the edges of the board 16.

Referring again to FIG. 1, the coin game apparatus 11 may, if desired, be embellished with flashing lights, sound effects and attention attracting graphics. Such embellishments are not shown as they may be of the kind commonly present in arcade games.

Figure 9:
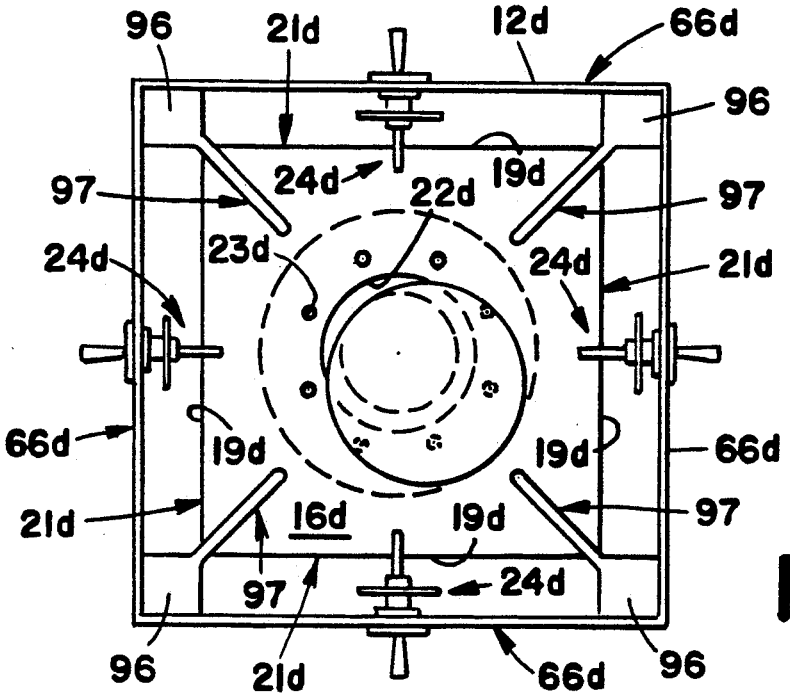
FIG. 9 is a top view of a second embodiment of the invention which enables simultaneous use by a greater number of players.

The above described embodiments of the invention enable play by a single player or simultaneous play by two players. In contrast to prior reciprocating coin pusher games, the invention can be adapted to accommodate a still greater number of simultaneous players. Referring to FIG. 9, for example, the cabinet 12*d* and game board 16*d* may be square and be proportioned to provide a separate players slot 19*d* along each of the four edges 21*d* of the board. Four of the swiveling coin chutes 24*d* may be secured to cabinet 12*d* each being at a separate one of the side walls 66*d* of the cabinet in position to roll coins on to the adjacent area of the board 16*d*. The coin collecting opening or house slot 22*d* may be circular, be centered on the game board 16*d* and one or more players holes 23*d* may be provided in board 16*d* between the coin collecting slot and each edge 21*d* of the board. Partition posts 96 may extend upward from the base of cabinet 12*d* at each corner of the cabinet to isolate each of the players slots 21*d* from each other. The posts 96 extend above the level of the game board 16*d* and each has an arm 97 which extends along a diagonal of the game board surface, towards the area of the surface that is swept by the revolving coin pusher 26*d*, in order to inhibit the exchange of coins between adjoining play areas. In a variation of the game, arms 97 may be shortened or omitted in order to promote such an exchange of coins. The players are then, in effect, competing against each other.

Other components of the coin game apparatus 11*d* of FIG. 9 may be essentially similar to the corresponding components of the previously described embodiments.

For purposes of example, FIG. 9 depicts a construction having a square cabinet 12*d* and which can accommodate four players. The cabinet 12*d* may have other configurations, such as a circular shape or a polygonal shape for example, and a smaller or larger number of coin chutes 24*d*, players slots 21*d*, and partitions 96 may be present to enable simultaneous play by a different number of players.

While the invention has been described with reference to certain particular embodiments for purposes of example, many modifications and variations of the construction are possible and it is not intended to limit the invention except as defined in the following claims.

We claim:

1. Coin game apparatus comprising:

a game board having a substantially level surface for supporting a plurality of coins or the like and having at least a first edge region at which coins may be pushed off of said surface and be dropped therefrom, a movable coin pusher disposed on said game board surface, drive means for revolving said coin pusher about a first vertical axis of revolution, and at least one coin chute for receiving and guiding player's coins and having a coin release end positioned to drop player's coins on to said surface.

2. The apparatus of claim 1 wherein said chute has a coin guiding slot having a configuration which positions coins in an upright orientation to cause rolling motion of said coins.

3. The apparatus of claim 1 further including means for enabling swiveling of said chute whereby said chute may be selectively aimed at different areas of said board surface.

4. The apparatus of claim 3 wherein said board surface has at least a first hole therein into which said player's coins may drop when said coin chute is positioned to direct said coins towards said first hole.

5. The apparatus of claim 4 wherein said first hole is at a location which is cyclically covered and uncovered by said coin pusher in the course of said revolution thereof.

6. The apparatus of claim 5 wherein said board surface has a coin collecting opening therein into which said player's coins may drop, said coin collecting opening being spaced apart from said first hole, further including means for at least temporarily segregating coins which drop through said first hole from coins which drop through said coin collecting opening thereby enabling counting of the coins which drop through said first hole.

7. The apparatus of claim 3 wherein said board surface has a plurality of spaced apart holes therein of sufficient size to receive said coins, said holes being at a series of different locations towards which said players coins may be directed by swiveling of said coin chute.

8. The apparatus of claim 7 wherein said board surface has a coin collecting slot extending across at least a portion of said surface, said slot being further from said end of said coin chute than said holes.

9. The apparatus of claim 1 wherein said movable coin pusher is eccentrically positioned relative to said first vertical axis of revolution.

10. The apparatus of claim 9 wherein said drive means also revolves said pusher about a second vertical axis that is spaced apart from said first vertical axis.

11. The apparatus of claim 10 wherein said coin pusher is concentric with said second vertical axis.

12. The apparatus of claim 11 wherein said pusher has a circular exterior surface.

13. The apparatus of claim 1 wherein said movable coin pusher has an exterior surface which extends upward from said board surface and wherein portions of said exterior surface of said coin pusher are more distant from said first axis of revolution than other portions of said exterior surface.

14. The apparatus of claim 13 wherein said exterior surface of said coin pusher is circular and wherein said pusher is in an eccentric relationship with said first axis of revolution.

15. The apparatus of claim 13 wherein said exterior surface of said coin pusher is non-circular and wherein said pusher is in concentric relationship with said first axis of revolution.

16. The apparatus of claim 1 wherein said coin pusher is located to remain spaced apart from said first edge region at all times in the course of said revolution of said pusher whereby player's coins accumulate on said board surface between said first edge region and the area which is swept by said pusher and said pusher urges accumulated coins in the direction of said first edge region.

17. The apparatus of claim 16 wherein said board has a central area at which said first axis of revolution is located and has a second edge region at which coins may be pushed off of said board surface which second edge region is at the side of said board surface that is opposite from said first edge region and wherein said apparatus includes a second coin chute positioned to drop a second player's coins on to said board surface between said central area and said second edge region.

18. The apparatus of claim 17 wherein said board surface has at least one hole situated between said central area thereof and said first edge region thereof and at least one other hole situated between said central area and said second edge region and has a coin collection slot extending across at least a portion of said board surface at a location which is between said one hole and said other hole, further including means for enabling swiveling of said first and second coin chutes by players.

19. The apparatus of claim 1 wherein said game board has a plurality of separate edge regions at which coins may be pushed off of said board surface and dropped therefrom, further including a plurality of said coin chutes each being positioned for dropping player's coins on to said board surface in the vicinity of a separate one of said edge regions.

20. The apparatus of claim 1 further including spring means for exerting downward pressure on said coin pusher.

21. The apparatus of claim 1 wherein said pusher drive means includes a first upright rotatable shaft situated below said pusher, a stationary first gear disposed in coaxial relationship with said first shaft, an arm extending radially from said first shaft above said first gear and being secured to thereto to turn therewith, a second rotatable shaft extending upward from said arm at a location thereon that is spaced apart from said first shaft, a second gear secured to said second shaft for rotation therewith, a third rotatable shaft extending upward and downward from said arm at a location thereon that is spaced apart from said first and second shafts, third and fourth gears secured to said third shaft for rotation therewith, said third gear being engaged with said first gear and said fourth gear being engaged with said second gear, means for securing said coin pusher to said second shaft for rotation therewith, and further includes a drive motor coupled to said first shaft to turn said first shaft.

22. Coin game apparatus comprising:

a cabinet having a substantially level floor forming a game board and upwardly extending side walls and a top formed at least in part of transparent material, said game board having opposite side regions with edges at which coins may be pushed off of said board and drop therefrom and having a plurality of holes in said game board which are spaced apart from said edge regions and from each other which holes are of sufficient size to enable dropping of coins from said game board at the locations of said holes, a movable coin pusher disposed on said game board and having an exterior surface which extends upward therefrom, means for revolving said coin pusher about a first vertical axis of revolution in a manner which causes said exterior surface of said pusher to move towards and away from each of said edge regions in the course of revolving about said axis whereby coins may be pushed off of said game board at said edge regions by the motion of said pusher, first and second coin chutes attached to said cabbinet at said opposite side regions of said game board and being positioned to drop players coins on to said game board, each of said coin chutes having a coin guiding slot shaped to position coins which roll therealong in an upright orientation, and means for swiveling said first and second coin chutes whereby players may aim coins at said holes in said game board.

23. The apparatus of claim 22 wherein said means for revolving said coin pusher about a first vertical axis also revolves said pusher about a second vertical axis that is spaced apart from said first axis.

24. The apparatus of claim 22 wherein said means for revolving said coin pusher sweeps said pusher over said holes during revolution of said pusher.

* * * * *